US007152543B2

(12) United States Patent
Raimondo

(10) Patent No.: US 7,152,543 B2
(45) Date of Patent: Dec. 26, 2006

(54) BOOM VANG FOR SAILBOATS

(75) Inventor: Antonio Raimondo, Via Mercadante 8, Milano (IT) 20124

(73) Assignee: Antonio Raimondo, Milan (IT)

( * ) Notice: Subject to any disclaimer, the term of this patent is extended or adjusted under 35 U.S.C. 154(b) by 0 days.

(21) Appl. No.: 10/559,875

(22) PCT Filed: Jun. 11, 2004

(86) PCT No.: PCT/EP2004/006428

§ 371 (c)(1),
(2), (4) Date: Dec. 7, 2005

(87) PCT Pub. No.: WO2005/005247

PCT Pub. Date: Jan. 20, 2005

(65) Prior Publication Data

US 2006/0137588 A1 Jun. 29, 2006

(30) Foreign Application Priority Data

Jul. 1, 2003 (EP) ..... 03425432

(51) Int. Cl.
*B63H 9/04* (2006.01)

(52) U.S. Cl. ..... 114/102.1; 114/97

(58) Field of Classification Search ..... 114/102.1, 114/102.19, 89, 90, 97
See application file for complete search history.

(56) References Cited

U.S. PATENT DOCUMENTS 4,406,240 A * 9/1983 Andersen ..... 114/99

* cited by examiner

*Primary Examiner*—Ed Swinehart

(57) ABSTRACT

A vang assembly for manipulating a sailboat boom which is hingendly connected to the lower portion of a sailboat mast (12). The vang assembly includes a rigid and unextensive vang (strut) (20) connected both to the mast (12) and to the boom. The first end portion is hingendly attached to the lower portion of the mast below the boom, and the second end portion is hingedly attached to a traveller (26) sliding on track (30) fixed to the boom at a location spaced outwardly from the lower portion of the mast. Traveller fore and aft movements are controlled by block and tackle system. Traveller sliding allows to control boom vertical position. When traveller is pulled forward (toward the mast), the boom is forced upwardly by rigid vang working as a strut, when traveller is pulled aftward (opposite the mast), boom is forced downward by the rigid vang working as a tie rod.

13 Claims, 6 Drawing Sheets

BOOM VANG FOR SAILBOATS

FIELD OF INVENTION

This invention relates to a vang assembly for controlling the boom of a sailboat.

BACKGROUND OF THE INVENTION

A vang is an adjustable device fitted to the underside of a boom to control the raising or lowering of the boom.

Vangs typology can be divided into two basic types: soft vangs and mechanical vangs. The most widely used vangs, in particular for smaller boat are soft vangs. A typical soft vang includes a multiple purchase block and tackle system including two or more blocks or pulleys attached to the boom, and a single line having one end secured to one of the pulley systems, with the line having a free end which is pulled out and released manually by the sailor. A soft vang increases sail efficiency by pulling down on the boom in medium or heavy air, thereby increasing the tension in the leech and reducing the spill of wind.

Soft vangs can only be used to pull down the boom. Thus, in slight winds or when docked, a wire or rope topping lift must be used to support the boom. Use of a topping lift is extremely undesirable because it increases the wind drag of the sailboat. Mechanical vangs represent an improvement over soft vangs in that they may both pull down on the boom and hold up the boom, thus eliminating the need for a wire or rope topping lift. There are four basic varieties of mechanical vangs.

The first variety is a tackle-equipped rigid vang. These vangs generally comprise a set of telescoping spring-loaded aluminum tubes with a tackle rigging longitudinally associated therewith. When the tackle rigging is tightened, it applies a downward force on the boom and compresses the spring within the telescoping aluminum tubes. As the rigging is loosened, the spring within the telescoping aluminum tubes extends, thus providing support for the boom. Typically, the spring comprises a steel coil; however, compressed-gas cylinder springs are also used.

A second variety of mechanical vangs are screwdriven or "rotary" vangs. In a screw-driven vang, a large turnbuckle is lengthened or shortened by turning a wheel or a pair of handles in the middle of the turnbuckle. Although capable of providing both tension in the leech and supporting the boom, screw-driven vangs have the serious disadvantage of being difficult and slow to adjust because of their heavy nature.

A third variety of mechanical vang are hydraulic vangs. Hydraulic vangs typically consist of a cylinder filled with hydraulic oil and a piston. A hydraulic pump controlled from the cockpit actuates the piston inward or outward to control the height of the boom.

The fourth variety of mechanical vang are flexible column actuated vangs. This type of vang is actuaded with a device that is capable of being moved between a contracted position and an extended position. When the adjustment mechanism is moved to a contracted position, the column is forced to bow arcuately to an arched position and the boom is forced in a downward direction. When the adjustment mechanism is released to extended position, the arcuately bowed column straightens and exerts forces pushing the boom upwardly.

Mechanical vangs have several serious problems. For the first three types, the telescoping tubes must be carefully maintained to avoid corrosion. In addition, if water is allowed to leak into the telescoping tubes, the metal springs may be particularly subject to corrosion. The telescoping springloaded tubes of these vangs must also be carefully machined, making them relatively expensive. Finally, these vangs are susceptible to denting and bending from transverse forces. Such damage inhibits the telescoping of the tubes, degrading the vang's performance. The fourth type of mechanical vang does not give a lower limit to the boom movement, making some mainsail operation difficult. Moreover first and fourth mechanical vang type have the serious limitation that the boom hold up control come from a constant elastic force that always needs pull down tackle rigging in force to maintain the boom at the desired level even in slight wind or when docked.

For these reasons there is an unresolved need in the art of boom vang system to have a simpler and lighter mechanism with hight boom control performance.

OBJECT OF THE INVENTION

It is an object of the invention to provide a vang system made of a rigid and unextensible strut hingedly attached to the mast and hingedly attached to a traveller sliding on a boom fixed track.

SUMMARY OF THE INVENTION

The present invention comprises a vang assembly for manipulating a sailboat boom which is hingendly connected to the lower portion of a sailboat mast. The vang assembly includes a rigid and unextensible vang (strut) connected both to the mast and to the boom. The first end portion is hingendly attached to the lower portion of the mast below the boom, and the second end portion is hingedly attached to a traveller sliding on track fixed to the boom at a location spaced outwardly from the lower portion of the mast. Traveller fore and aft movements are controlled by block and tackle system.

Traveller sliding allows to control boom vertical position. When traveller is pulled forward (toward the mast), the boom is forced upwarly by rigid vang workin as a strut, when traveller is pulled aftward (opposite the mast), boom is forced downward by the rigid vang working as a tie rod.

A simpler configuration of the system includes traveller forward movement control only and therefore the upward boom forcing control. In this case the downward boom forcing control is made by a block and tackle traditional vang.

The boom vang system of the invention completely elimanates the problems above referred to the other mechanical system, in particular avoids any complex mechanical part, such as spring, telescopic pipe, hydraulic pump etc. and therefore avoids necessity of maintenance.

Boom control is made by a track and traveller system that is a well known extremely reliable and absolutely durable system. The rigid strut made by aluminum, composites or other materials is a strong, light and durable (no maintenance) component of the system.

Up and down boom control can be easily performed also without tension to the pull down tackle rigging in particular in light wind or when docked. All the mainsail operation become very easy.

One of the most important advantage of this system, particularly appreciated by racing boat, is the saving of weight with respect to other mechanical system. Another significant advantage is the possibility to easily use special strut section profile to reduce wind drag.

The above brief description sets forth rather broadly the more important features and advantages of the present disclosure so that the detailed description that follows may be better understood, and so that the present contributions to the art may be better appreciated. There are, of course, additional features of the disclosure that will be described hereinafter which will form the subject matter of the claims appended hereto. In this respect, before explaining the embodiment of the disclosure in detail, it is to be understood that the disclosure is not limited in its application to the details of the construction and the arrangements set forth in the following description or illustrated in the drawings. The present invention is capable of other embodiments and of being practiced and carried out in various ways, as will be appreciated by those skilled in the art. Also, it is to be understood that the phraseology and terminology employed herein are for description and not limitation.

Figure 1:
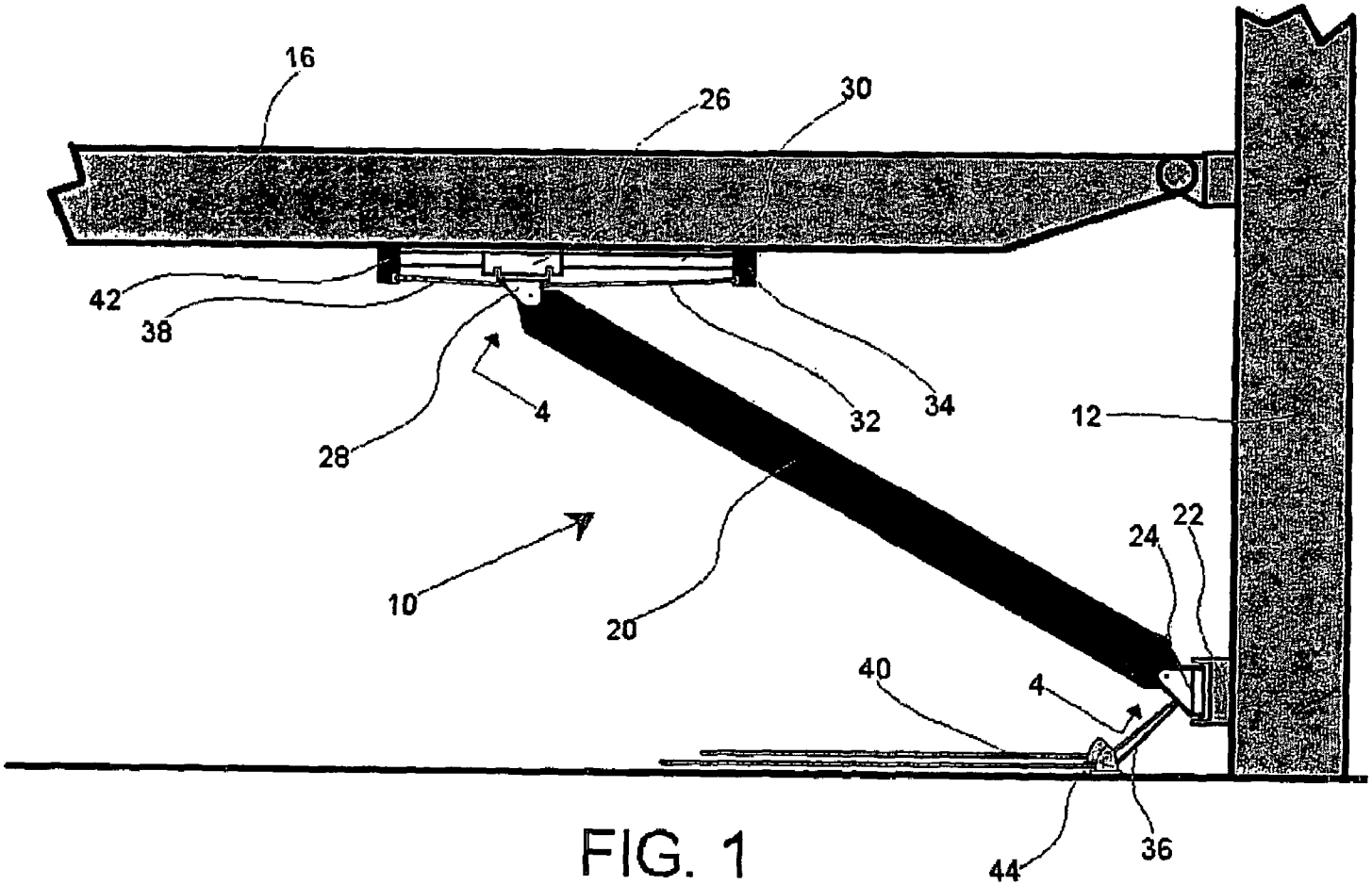
FIG. 1 is a side elevational view illustrating a first embodiment of the mechanical vang of the present invention disposed between the mast and the boom of a sailboat.

FIG: 3 is a sectional side plan view of the strut (20) of FIG.1 showing inside hold up rigging.

Figure 4:
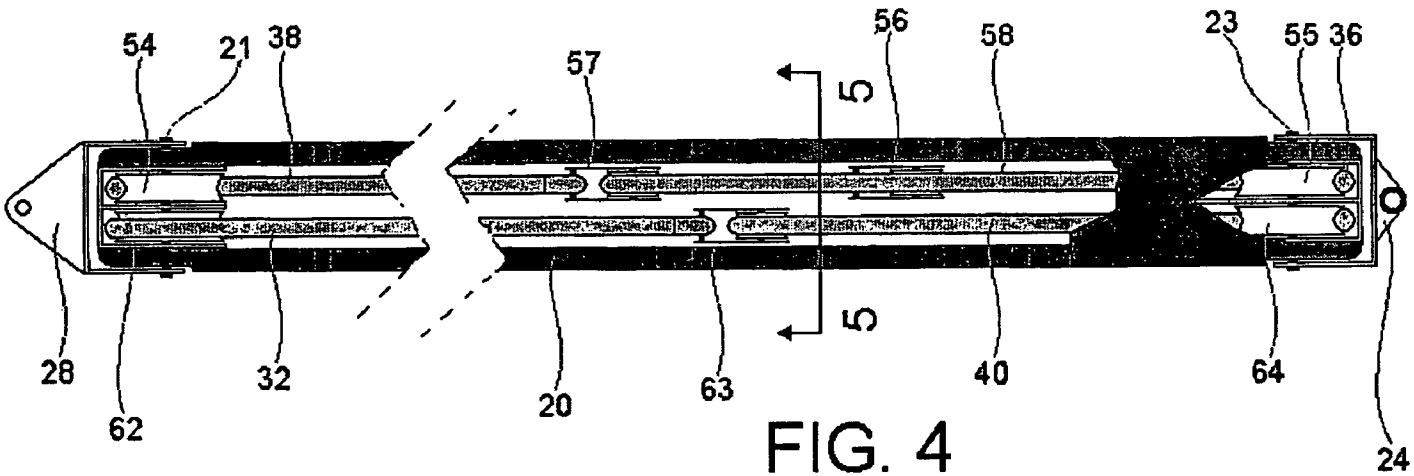

FIG. 4 is a plan of strut 20, with an inside view, along the line 4—4 of FIG. 1.

Figure 5:
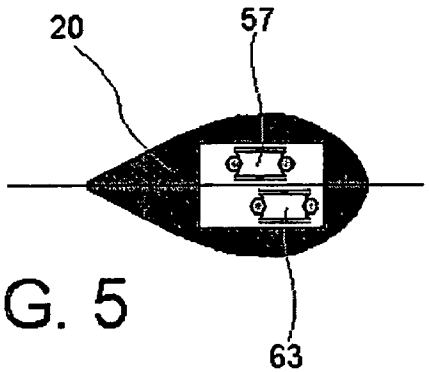

FIG. 5 is a sectional view along the line 5—5 of FIG. 4

Figure 6:
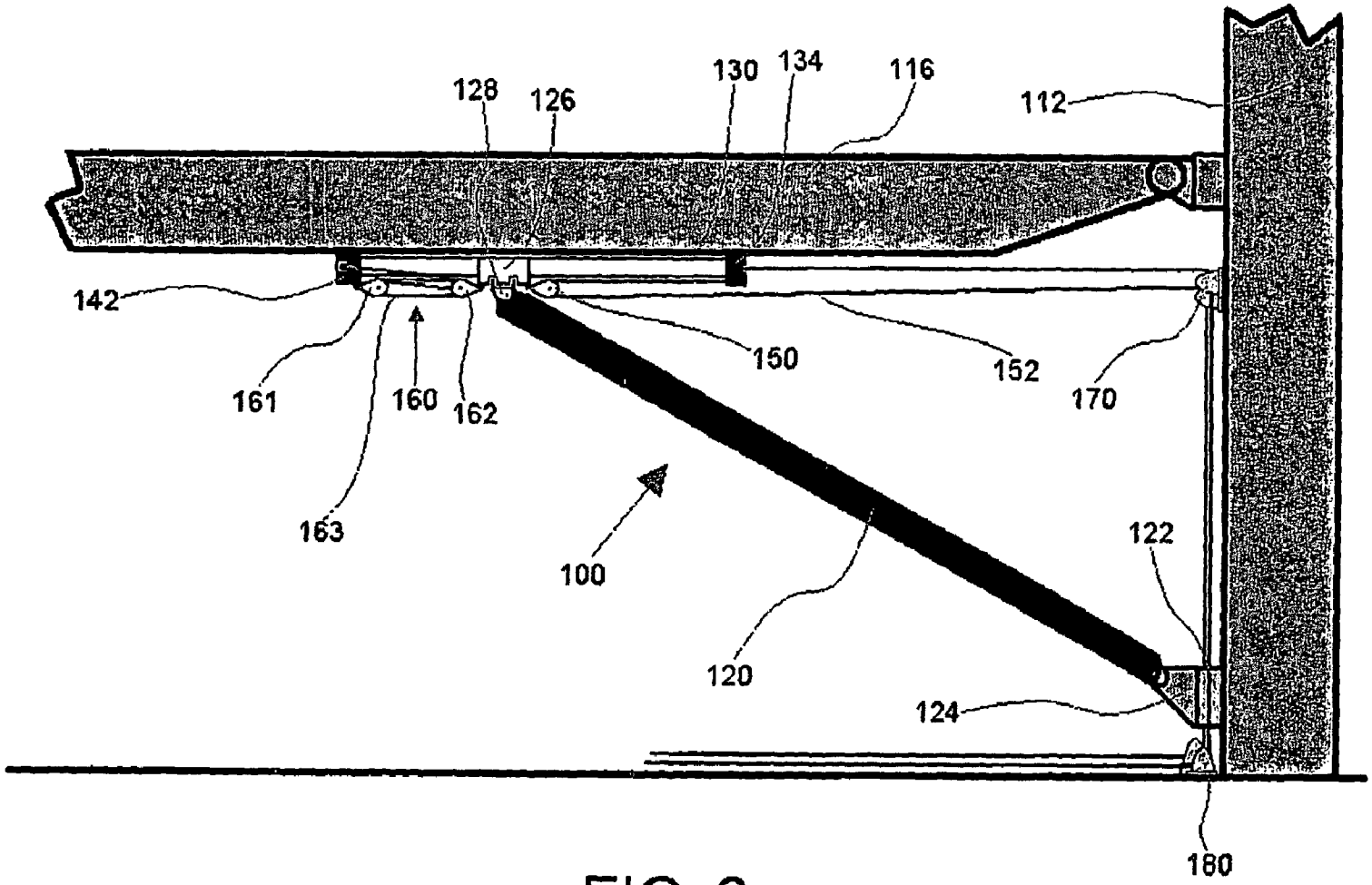

FIG. 6 is a side view of an additional embodiment of the mechanical vang of the present invention.

Figure 7:
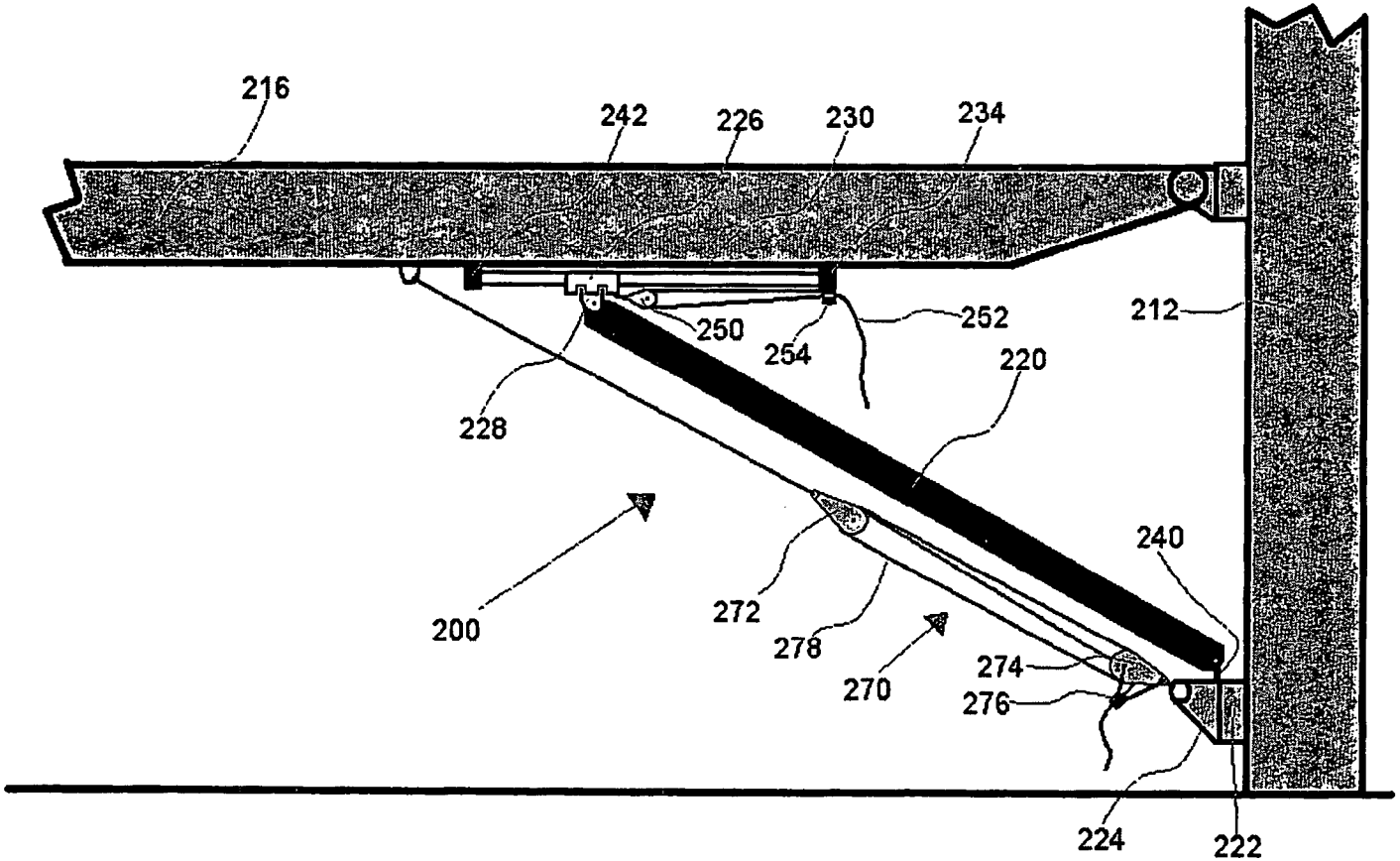

FIG. 7 is a side view of an additional embodiment of the mechanical vang of the present invention.

DESCRIPTION OF THE PREFERRED EMBODIMENTS

A vang assembly, generally designated 10, of the present invention is shown in FIG. 1 positioned between a lower portion of a mast 12 and a boom 16 of a sailboat. The vang assembly broadly includes a rigid strut, generally designated 20, hingendly connected to the mast 12 with a tang 22 via hinge 24 and hingendly connected to a traveller 26 via hinge 28. The traveller 26 is sliding on a track 30 fixed below the boom 16. This embodiment includes an hollow strut 20 made by aluminum or composite material pipe. Sliding traveller 26 is controlled in his forward and aft movements by two rigging systems.

To pull traveller 26 forward (toward the mast),forcing boom upwarly, a block and tackle system (better described in FIG. 3) inside the hollow strut 20 is provided. This block and tackle system (better described in FIG. 3) ends with ropes 32 and 40. Rope 32 is coming out from the hight end of strut 20 and is attached to the forward end 34 of the track 30, rope 40 is coming out from the the low end of strut 20 and, throught blocks 44, is carried in a proper position in the boat where a clam cleat or similar fixing device can be positioned. Rope 40 is a dynamic type to work as boom shock absorber.

To pull traveller 26 aftward (opposite the mast), forcing boom downward, a block and tackle system (better described in FIG. 2) inside the hollow strut 20 is provided. This block and tackle system (better described in FIG. 2) ends with ropes 38 and 36. Rope or wire 38 is coming out from the high end of strut 20 and is attached to the aft end 42 of the track 30, rope 36 is coming out from the low end of the strut 20 and trought blocks 44 is carried in a proper position in the boat where a clam cleat or similar fixing device can be positioned.

Figure 2:
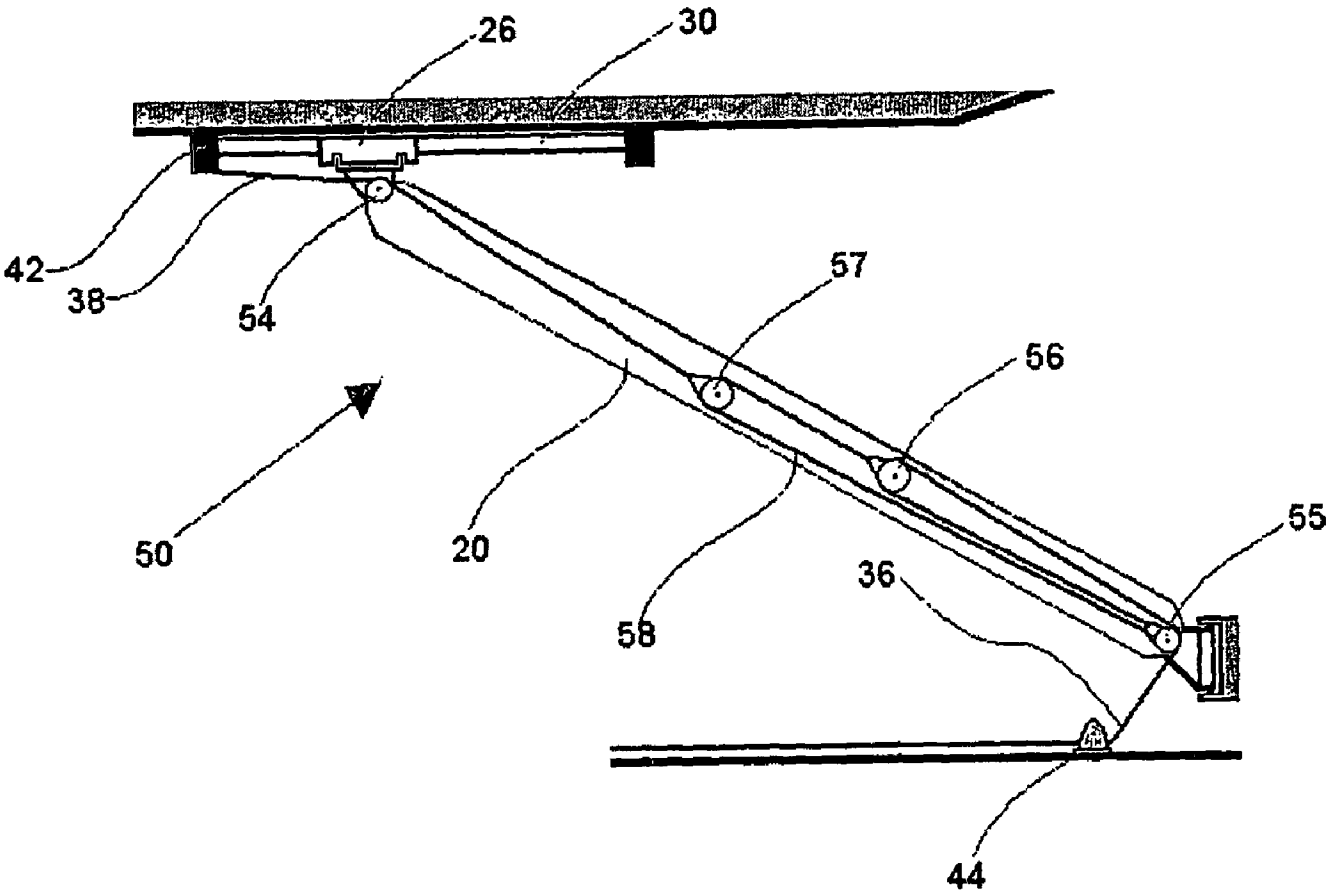
FIG. 2 is a sectional side plan view of the strut (20) of FIG.1 showing inside pulling down rigging.

FIG. 2 is the sectional plan, viewing inside, of hollow strut 20, described above, with the representation, generally designated 50 of the block and takle system foreseen for aftward pulling (opposite the mast) of traveller 26. Rope or wire 38 is attached to the aft end 42 of track 30, going inside hollow strut 20 trought pulley 54, and is attached to pulley 57. Rope 58 is attached to pulley 55, reevs into pulley 57 and is attached to pulley 56. Rope 36 is attached to pulley 55, reevs into pulley 56 and 55, going out from low end of strut 20, and trought block 44 is carried in a proper position in the boat where a clam cleat or similar fixing device can be positioned. Pulleys 54 and 55 are hinged with pins to the hight and to the low end of strut 20, while pulley 56 and 57 are free to move inside hollow strut 20. Rigging system made by ropes 38, 58 and 36 and pulleys 54, 55,56 and 57 provides a mechnical advantage. As will be appreciated by those knowledgeable in the art, there are other well known block and takle system that can be used for the same pourpose of the present invention.

Figure 3:
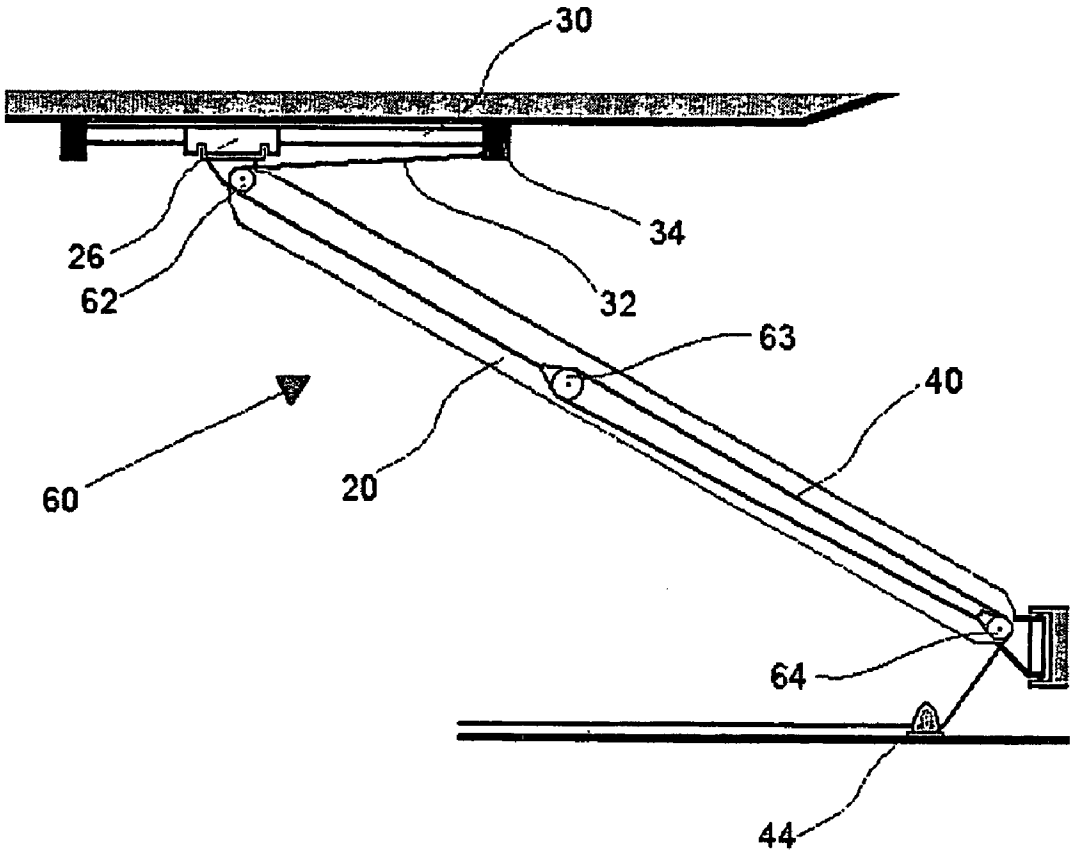

FIG. 3 is the sectional plan, viewing inside of hollow strut 20, described above, with the representation, generally designated 60, of the block and takle system foreseen for forward pulling (toward the mast) of traveller 26. Rope 32 is attached to forward end 34 of track 30, going inside hollow strut 20 trought pulley 62 and is attached to pulley 63. Rope 40 is attached to pulley 64, reevs into pulley 63 and 64, going out from low end of strut 20, and trought block 44 is carried in a proper position in the boat where a clam cleat or similar fixing device can be positioned. Pulleys 62 and 64 are hinged with pins to the hight and to the low part of strut 20, while pulley 63 is free to move inside hollow strut 20. Rigging system made by ropes 32 and 40 and blocks 62 63 and 64 provide a mechanical advantage. As will be appreciated by those knowledgeable in the art, there are other well known block and takle system that can be used for the same pourpose of the present invention.

FIG. 4 provide a plan (view 4—4 of FIG.1) with an inside view of strut 20. This view shows both the boom pulling up system, formed by pulley 63, 64, 62 and rope 32, 40, and boom pulling down system, formed by pulley 54, 55, 56, 57 and rope 36, 38, 58. Pulley 56, 57 and 63 are free to move inside the hollow strut 20. Pulley 54 and 62 are hinged togheter with strut 20 and hinge 28 via pin 21; pulley 55 and 64 are hinged togheter with strut 20 and hinge 24 via pin 23.

For this embodiment a strut with wing contour type section profile has been used (see FIG.5) for wind drag reduction.

It is understood that, even if, this profile is a preferred choise for wind drag reduction, every other suitable profile section could be used.

FIG. 5 is section view 5—5 of FIG. 4, showing the internal space of strut 20 foreseen for the movement of pulley systems. In this section pulley 57 and 63 can be seen.

In addition to that above described, there is another embodiment, generally described 100 in FIG. 6, where strut 120 doesn't foresee inside space for block and takle. Strut 120 can be made by aluminum or composite material and in comparison with strut 20 of FIG. 1 is thiner giving less wind drag and less production costs. This vang assembly broadly includes a rigid strut 120 hingendly connected to the mast 112 with a tang 122 via hinge 124 and hingendly connected to a traveller 126 via hinge 128. The traveller 126 is sliding on a track 130 fixed below the boom 116.

Sliding traveller 126 is controlled in his forward and aft movements by two rigging system.

To pull traveller 126 forward (toward the mast),forcing boom upwarly, a block 150 and a rope 152 are provided. Rope 152 is attached to forward end 134 of track 130, reevs into blocks 150,170 and 180 going in a proper position where a fixing device can be installed. Rope 152 is a dynamic type to work as boom shock absorber. Rope 152 and block 150 provide a mechanical advantage. As will be appreciated by those knowledgeable in the art, ther are other well known block and takle system that can be used for the same pourpose.

To pull traveller 126 aftward (opposite the mast), forcing boom downward, a block and tackle system 160 is provided. A rope 163 is reeved between block 161 and 162 for providing mechanical advantage between the two blocks. A first free end of rope 163 passes trought a pulley fixed in the aft end 142 of track 130, going forward inside the hollow track 130 and trought blocks 170 and 180 going in a proper position where a fixing device can be installed. A second free end of rope 163 is attached to either block 161 or block 162. As will be appreciated by those knowledgeable in the art, ther are other well known block and takle system that can be used for the same pourpose.

In addition to that above described, there is another embodiment, generally described 200 in FIG. 7, where strut 220 doesn't foresee inside space for block and takle. Strut 220 can be made by aluminum or composite material and in comparison with strut 120 of FIG. 6 it has only the boom upwarly control leaving downwarly boom control to a traditional soft block and takle sistem 270. This vang assembly broadly includes a rigid strut, generally designated 220, hingendly connected to the mast 212 with a tang 222 via hinge 240 and hingendly connected to a traveller 226 via hinge 228. The traveller 226 is sliding on a track 230 fixed below the boom 216. Sliding traveller 226 is controlled in his forward movement by a rigging system.

To pull traveller 126 forward (toward the mast), forcing boom upwarly, a block 250 and a rope 252 are provided. Rope 252 is attached to forward end 234 of track 230, reevs into block 250, going to a cam cleat 254 for pulling. Rope 252 is a dynamic type to work as boom shock absorber. Rope 252 and block 250 provide a mechanical advantage. Rope 252 can be also carried in a proper position of the boat where a fixing device can be installed. As will be appreciated by those knowledgeable in the art, there are other well known block and takle system that can be used for the same pourpose.

For downward boom control a soft standard vang 270 is installed. A rope 278 is reeved between block 272 and 276 for providing mechanical advantage between the two blocks. A first free end of rope 278 passes trought cam cleat 276 for pulling. Rope 278 can be also carried in a proper position of the boat where a fixing device can be installed. A second free end of rope 278 is attached to either block 272 or block 276.

As will be appreciated by those knowledgeable in the art, ther are other well known block and takle system that can be used for the same pourpose.

While preferred embodiments and example configurations have been shown, it is to be understood that various further modifications and additional configuration will be apparent to those skilled in the art. It is intended that the specific embodiments and configurations herein disclosed are illustrative of the preferred and best modes for practicing the invention, and should not be interpreted as limitations on the scope of the invention as defined by the appended claims.

The invention claimed is:

1. A vang assembly (10) for manipulating a sailboat boom (16) in which a supporting part is hingendly connectable to a lower portion of a sailboat mast (12) with a first end portion hingendly attachable to the lower portion of the mast (12) below the boom, and a second end portion hingendly attached to a traveller (26) sliding on a track (30) fixable to the boom (16) at a location spaced outwardly from the lower portion of the mast (12), characterized in that:

said supporting part is a rigid unexstensible strut (20) and said traveller (26) fore and aft movements are controlled by adjustement means, said adjustment means to pull said traveller (26) forward toward the mast, so to force said boom (16) upwarly and to pull traveller (26) aftward opposite the mast, so to force said boom (16) downward.

2. A vang assembly as specified in claim 1 in which the rigid unextensible strut is a hollow profile.

3. A vang assembly as specified in claim 2 in which the adjustement means are block and tackle assemblies, positioned inside the hollow strut.

4. A vang assembly as specified in claim 3 in which for said block and tackle system that pulls said traveller forward toward the mast a dynamic type rope is used.

5. A vang assembly as specified in claim 2 in which the strut is made with a wing contour type section profile to reduce wind drag.

6. A vang assembly as specified in claim 1 in which the adjustement means are block and tackle assemblies attached to the traveller and to the aft end and forward end of said track.

7. A vang assembly as specified in claim 6 in which a hollow track allows an aftward pulling rope to return toward the mast passing inside the track.

8. A vang assembly as specified in claim 6 in which for said block and tackle system that pulls said traveller forward toward the mast a dynamic type rope is used.

9. A vang assembly as specified in claim 6 in which the strut is made with a wing contour type section profile to reduce wind drag.

10. A vang assembly (200) for manipulating a sailboat boom (216) comprising a soft block and tackle vang (270) indipendently connectable both to the boom (216) and to the mast (212) to force said boom (216) downward and a supporting part with a first end portion hingendly attachable to the lower portion of the mast (212) below the boom, and a second end portion hingendly attached to a traveller (226) sliding on a track (230) fixable to the boom (216) at a location spaced outwardly from the lower portion of the mast (212), characterized in that:

said supporting part is a rigid unexstensible strut (220) and said traveller (226) fore movements are controlled by adjustement means, said adjustment means to pull said traveller (226) forward toward the mast, so as to force said boom (216) upwardly.

11. A vang assembly as specified in claim 10 in which the adjustement means to control said traveller in forward movement toward the mast is a block and tackle assembly.

12. A vang assembly as specified in claim 11 in which for said block and tackle system that pull said traveller forward toward the mast a dynamic type rope is used.

13. A vang assembly as specified in claim 10 in which the strut is made with a wing contour type section profile to reduce wind drag.

* * * * *